US005431070A

United States Patent [19]

Thames

[11] Patent Number: 5,431,070

[45] Date of Patent: Jul. 11, 1995

[54] ADJUSTABLE KNIFE BLADE GUIDE

[76] Inventor: Charles L. Thames, 601 Overland Rd., Lot 28, Clinton, N.C. 28328

[21] Appl. No.: 254,686

[22] Filed: Jun. 6, 1994

[51] Int. Cl.[6] ..... B24D 15/08

[52] U.S. Cl. ..... 76/88; 76/84

[58] Field of Search ..... 76/82, 82.2, 84, 88

[56] References Cited

U.S. PATENT DOCUMENTS

| | | | |
|---|---|---|---|
| 78,771 | 6/1868 | Thayer | 76/84 |
| 371,689 | 10/1887 | Kistner | 76/82.2 |
| 458,243 | 8/1891 | Townsend | 76/82.2 |
| 673,933 | 5/1901 | Wallace | 76/82.2 |
| 895,580 | 8/1908 | Northam | 76/82.2 |
| 1,075,690 | 10/1913 | Buck . | |
| 1,158,048 | 10/1915 | Hawks | 76/88 |
| 1,269,898 | 6/1918 | Ball | 76/88 |
| 1,936,990 | 11/1933 | Piermann | 76/82.2 |
| 2,458,856 | 1/1949 | Jacobson . | |
| 2,459,391 | 1/1949 | Otis | 76/82 |
| 2,896,482 | 7/1959 | Hyde | 76/84 |
| 4,016,649 | 4/1977 | Kloster | 30/373 |

*Primary Examiner*—Hwei Siu Payer
*Attorney, Agent, or Firm*—John G. Mills Associates

[57] ABSTRACT

This invention is a blade guide to allow the angle that the blade addresses a sharpening rod to be repeatedly and accurately re-established. This is accomplished through the provision of a guide plate outwardly projecting from the sharpening rod with a guide arm thereon. When the blade is placed with the back of the blade at the juncture between the guide plate and the guide arm, and the cutting edge of the blade against the sharpening rod the angle the blade addresses the sharpener can repeatedly be re-established before each sharpening stroke of such blade against the sharpener. Once this correct angle is established, it can be maintained even through the blade is no longer engaged with the guide. By making the guide arms adjustable longitudinally along the guide plate, the optimum angle can be set for an infinite number of different sizes of blades. Also indicia is provided on the guide plate so that the proper location of the guide arm can be readily determined by reference to such indicia.

5 Claims, 1 Drawing Sheet

ADJUSTABLE KNIFE BLADE GUIDE

FIELD OF THE INVENTION

This invention relates to a guide means and more particularly to adjustable guides for gauging the correct angle of a blade against a sharpener.

BACKGROUND OF INVENTION

The angle that a blade addresses or is disposed to a sharpening surface determines the sharpness of the blade as well as determining how long the edge will last before dulling. All knives have an optimum blade setting which will, when sharpened at that angle, give a sharp cutting edge that will last for an extended period of time before needing re-sharpening.

The above is particularly important in knives that are used professionally, such as in meat packing house, poultry packing houses, seafood processing plants, and the like where razor sharp knives are needed to keep worker production up and to prevent excessive worker fatigue.

Even experienced meat cutters have difficulty in consistently setting the correct angle of the blade against the sharpener to obtain maximum sharpness while at the same time putting an edge on the knife that will not dull quickly. If the angle is less than optimum, the edge will be so thin that it will quickly dull while if the angle is greater than optimum, then the cutting edge will be blunt and will not take a sharp edge.

At each worker station in meat processing plants there is usually provided a sharpening rod to allow the worker to resharpen his or her knife as needed. There also is usually a smooth steel rod so that a few strokes on the same will allow the worker to maintain a superbly sharp edge. Neither of these rods will give satisfactory results, however, if the angle that the knife blade is held to the rod is incorrect.

Various blade holders and guides have been developed to set the correct angle of knives, scissors and tool blades to sharpening means, whether it be a sharpening rod, flat stone, grinding wheel, or the like. Each of these blade holders, however, are either difficult and complicated to use, or are of a set angle which makes them not readily adaptable to different types and sizes of knives which require different angle of address to the sharpening means to achieve the optimum edge on the knife blade.

CONCISE EXPLANATION OF PRIOR ART

U.S. Pat. Nos. 1,158,048 to Hawks, U.S. Pat. No. 2,896,482 to Hyde and U.S. Pat. No. 78,771 to Thayer are all considered of interest in that they disclose sharpening devices including a sharpening rod with disk-type means for putting an initial edge on the knife.

U.S. Pat. Nos. 2,458,856 to Jacobson is considered of interest in that it discloses a knife sharpener with an elongated slot and a sharpening rod embedded in one side thereof.

U.S. Pat. No. 2,459,391 to Otis discloses a knife rack and edger including a discussion on the angle at which the blade addresses the sharpening means.

U.S. Pat. Nos. 1,936,990 to Piermann, U.S. Pat. No. 1,075,690 to Buck and U.S. Pat. No. 895,580 to Northam are all considered of general interest in that they disclose scissor sharpeners with means for holding the blade during the sharpening process.

Finally, U.S. Pat. No. 458,243 to Townsend is considered of general interest in that it discloses a bar-like sharpening means for sharpening knives, scissors, or shears.

BRIEF DESCRIPTION OF INVENTION

After much research and study into the above mentioned problems, the present invention has been developed to provide an adjustable knife blade guide that sets the angle that the knife addresses the sharpening means at the beginning of the sharpening stroke.

As a knife blade is pulled downwardly and across the sharpening rod or similar means, the person doing the sharpening can easily maintain that angle of address while the entire length of blade is stroked across the sharpening means. The blade is then placed on the opposite side of the rod, the proper angle established by the guide of the present invention, and the knife once again stroked across the sharpener, out of engagement with the guide, but with the appropriate angle of address being maintained by the person sharpening the knife. These alternate strokes on opposite sides of the knife blade can be repeated several times to achieve a maximum edge on the knife.

A few subsequent strokes on a smooth steel rod will allow the blade to maintain a superbly sharp edge by eliminating any rough spots that were left when the sharpening rod was addressed. In summary, the guide of the present invention is used to initially establish the correct angle a blade addresses a sharpening means prior to the sharpening strokes being pulled across such means.

In view of the above it is an object of the present invention to provide an adjustable knife blade guide that allows the user to set the angle that the knife addresses the sharpening means.

Another object of the present invention is to provide an adjustable guide means mounted on the end of a rod-type sharpener to establish the optimum angle prior to the knife being stroked downwardly and across such sharpener.

Another object of the present invention is to provide a knife blade angle guide with indicia thereon to allow accurate settings of the same.

Another object of the present invention is to provide, in a knife blade guide, at least one adjustable guide arm with a set screw to hold the same in proper adjustment.

Another object of the present invention is to provide an adjustable knife blade guide for mounting on both sharpening rods and smooth steel rods.

Other objects and advantages of the present invention will become apparent and obvious from a study of the following description and the accompanying drawings which are merely illustrative of such invention.

DETAILED DESCRIPTION OF INVENTION

Figures 1, 2, 3, 4, 5, 6:
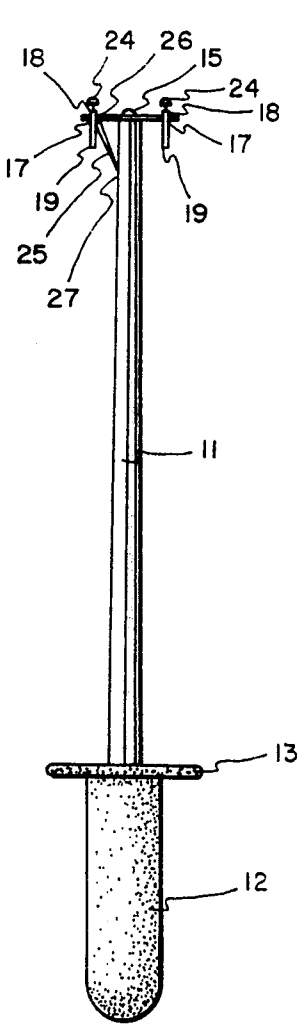
FIG. 1 is a side elevational view of the adjustable knife blade guide of the present invention.
FIG. 2 is a top plan view thereof.
FIG. 3 is an end elevational view of the adjustable guide arm used on the blade guide of the present invention.
FIG. 4 is a front elevational view of a modification of the blade guide of the present invention.
FIG. 5 is a top plan view thereof.
FIG. 6 is an end elevational view of the modified guide arm.

With further reference to the drawings, the adjustable knife blade guide of the present invention, indicated generally at 10, is preferably mounted on a sharpening means 11 that can be in the form of a sharpening rod to put the edge on the blade or a smooth steel rod for setting the edge.

The sharpening means 11 can either be permanently mounted, or as is more usually the case, can include a handle 12 mounted on one end thereof with an adjacent handle guard 13.

The blade guide 10 of the present invention is mounted on or adjacent one end of the sharpening means 11. If it is being mounted on a rod-shaped sharpener, it would be mounted on the end opposite the handle 12.

The adjustable blade guide 10 of the present invention includes a guide plate 14 with an opening in the center thereof to allow mounting screw 15 to pass therethru. This mounting screw is used to mount the guide on the sharpening means 11. If this means is a rod-type sharpener or steel, the guide 10 is mounted on the end opposite handle 12 as can clearly be seen in FIGS. 1 and 4. It should be noted that the guide plate 14 is disposed perpendicular to the sides of the sharpening means 11. It also should be noted that by loosening the mounting screw 15, it can be turned so that different sides of the sharpening means 11 will be therebelow when disposed in the position shown in said FIGS. 1 and 4.

Referring specifically to the guide shown in FIGS. 1 through 3, the guide plate 14 includes a pair of longitudinal slots 16 therein. A pair of guide arms 17 include a slide portion 18 and a guide finger 19. Grooves 20 are provided on opposite sides of slide portion 18 as can clearly be seen in FIG. 3.

A set screw 21 threadingly passes through the upper portion of one side of the slide portion 18 and into the groove 20 therebelow.

From the above description it can be seen that the guide arms 17 can be moved longitudinally inwardly and outwardly along the longitudinal slots 16 of guide plate 14 with such plate engaging the grooves 20 thereof. Whenever the desired longitudinal position is reached, set screw 21 can be tightened to engage the guide plate 14 to hold the guide arms 17 in place.

Evenly spaced indicia 22 are provided on the upper surface of guide plate 14 so that the position or location of the guide arms on the guide plate can be readily and accurately determined.

The guide arms 17 will, of course, always be spaced equal distance from the sharpening means 11 when the type sharpener shown in FIG. 1 is used.

When the adjustable blade guide 10 of the present invention is configured as shown in FIGS. 4 through 6, the guide plate 14 is elongated and rectangular-in-cross-section. The slide portion 8 of the guide arms 17 have a rectangular opening 23 therein coinciding to the rectangular cross-section of guide plate 14 as can clearly be seen in FIG. 6.

A set screw 24 threadingly passes through the top of the slide portion 18 and into opening 23. When this opening is moved longitudinally over the guide plate 14, and the correct location is determined by referring to the indicia 22, then the set screw is tightened down to hold the guide arm in place.

The version of the adjustable blade guide shown in FIGS. 4 through 6 is secured to the sharpening means 11 in the same manner as the version shown in FIGS. 1 through 3.

To use the adjustable blade guide 10 of the present invention, the end of the sharpening means it is to be used in conjunction with can be tapped or otherwise prepared for mounting of said guide. Since the tapping of means to accept screw threads or the like is well known to those skilled in the art, further detailed discussion of the same is not deemed necessary.

A mounting screw or other suitable means 15 is used to mount the guide arm on the sharpening means. The guide arm are then adjusted longitudinally along the blade guide until the correct distance from the sharpening means 11 is reached that will give the proper angle to the knife or other blade 25 when disposed between such guide arm and the sharpening means as can clearly be seen in the upper portion of FIGS. 1 and 4. The set screw in the guide arm is then tightened to secure such arm to the guide plate. The guide arm on the opposite end of the guide plate is similarly tightened on such guide plate the same distance from the sharpening means 11. The present invention is now ready to use.

The widest part of the blade of most knives is adjacent the handle. The correct angle, therefore, would usually be set at this point. The blade is then placed with the back 26 of the blade 25 disposed at the juncture between the guide arm 17 and the guide plate 14 with the cutting edge 27 of the blade 25 resting against the sharpening means 11. This sets the proper or optimum sharpening angle.

The blade 25 is then pulled longitudinally across the sharpener 11 while at the same time moving down the sharpener from the guide end thereof toward the handle or mounting end thereof. Since the correct angle that the blade addresses the sharpening means has been set by the guide arm 17, when the blade leaves contact with such guide arm, the correct angle can be easily held by the person (not shown) sharpening the knife until the tip of the blade leaves engagement with the sharpener 11.

The blade 25 is then placed on the opposite side of the sharpener 11, engaging the other guide arm 17, and the sharpening process repeated.

These alternate sharpening strokes are continued until the cutting edge 27 of the blade 25 is razor sharp.

If desired, a smooth steel means 11 with the same guide setting on the blade guide can be used to set the edge on the blade 25.

It is to be understood, of course, that the adjustable guide arm could be mounted at the opposite ends of the sharpening means 11, particularly if a whet stone or similar sharpening means was used. In that case the correct angle would alternately be set at one end of the sharpener and then at the other.

The terms "upper", "lower", "ends", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A blade angle set comprising: a sharpening means; a guide plate means; means for mounting said guide plate means on said sharpening means at generally a perpendicular angle thereto; at least one guide arm means slideably adjustably mounted on said guide plate means in spaced relation to said sharpening means; and means slidably along the guide plate means for releasably securing said guide arm means on said guide plate means and for slidably adjusting the guide arm means relative to the guide plate means whereby the angle that a blade addresses the sharpening means can be repeatedly duplicated by placing said blade between the junction of the guide plate means and the guide arm means, and the sharpening means.

2. The blade guide of claim 1 wherein said releasably securing means comprises a slot and a set screw.

3. The blade angle set of claim 1 wherein said sharpening means is a rod-type sharpener.

4. The blade angle set of claim 1 wherein the sharpening means is a smooth steel rod.

5. The blade angle set of claim 1 wherein indicia is provided on said guide plate means so that the correct adjustable position of said guide arm means can readily be determined.

* * * * *